US005542220A

United States Patent [19]

Yoshimura et al.

[11] Patent Number: 5,542,220

[45] Date of Patent: Aug. 6, 1996

[54] HYDROSTATIC ANTI-VIBRATION SYSTEM AND ADJUSTING METHOD THEREFOR

[75] Inventors: Mitsuhiro Yoshimura; Kazunobu Fujita, both of Nagasaki; Akira Teramura, Tokyo, all of Japan

[73] Assignees: Mitsubishi Jukogyo Kabushiki Kaisha, Tokyo; Obayashi Corporation, Osaka, both of Japan

[21] Appl. No.: 297,886

[22] Filed: Aug. 30, 1994

[30] Foreign Application Priority Data

| | | | |
|---|---|---|---|
| Nov. 30, 1993 | [JP] | Japan | 5-300500 |
| Nov. 30, 1993 | [JP] | Japan | 5-300501 |
| Nov. 30, 1993 | [JP] | Japan | 5-300502 |
| Jan. 11, 1994 | [JP] | Japan | 6-001351 |
| Jan. 25, 1994 | [JP] | Japan | 6-006214 |

[51] Int. Cl.[6] ..... F04H 9/02

[52] U.S. Cl. ..... 52/167.1; 52/167.2; 52/167.4; 52/168; 188/378

[58] Field of Search ..... 52/167.1, 167.2, 52/167.3, 167.4, 167.5, 167.6, 168; 188/378, 379, 380; 267/136

[56] References Cited

U.S. PATENT DOCUMENTS

| | | | |
|---|---|---|---|
| 4,266,379 | 5/1981 | Aguilar | 52/167.4 X |
| 4,873,798 | 10/1989 | Sato | 52/167.2 |
| 4,922,671 | 5/1990 | Sato | 52/167.2 |
| 4,951,441 | 8/1990 | Noji et al. | 52/167.2 X |

*Primary Examiner*—Carl D. Friedman
*Assistant Examiner*—Winnie Yip
*Attorney, Agent, or Firm*—Wenderoth, Lind & Ponack

[57] ABSTRACT

A hydrostatic anti-vibration system includes a main tank provided on a construction to be suppressed from vibrating and having a main tank body of substantially flat rectangular configuration. Hollow vertical extensions extend upwardly from peripheral edge portions of the main tank body and are filled with a working liquid at a predetermined level with upper air chambers maintained thereabove. Ducts communicate the upper air chambers of the hollow vertical extensions. Intermediate tank portions are disposed at the intermediate portions of respective ducts and contain a vibration suppressing liquid. A pivotal plate is disposed in each of the intermediate tank portions to separate the interior space of the intermediate tank portion into a pair of chambers respectively connected to corresponding portions of the duct. The plate pivots in response to flow pressure of the vibration suppressing liquid. A damping mechanism provides a resistance against displacement of the pivotal plate.

15 Claims, 6 Drawing Sheets

HYDROSTATIC ANTI-VIBRATION SYSTEM AND ADJUSTING METHOD THEREFOR

BACKGROUND OF THE INVENTION

1. Field of the Invention

The present invention relates generally to a hydrostatic anti-vibration system for suppressing vibration of a construction utilizing motion of a hydraulic fluid filled in a tank. The invention also relates to a method for adjusting an active vibration frequency range to a natural period of the actual construction.

2. Description of the Related Art

Such type of hydrostatic anti-vibration system has been proposed in commonly owned Japanese Unexamined Patent Publication No. 5-60173. A brief discussion will be given of the prior proposed hydrostatic anti-vibration system with reference to FIG. 8. As shown in FIG. 8, the hydrostatic anti-vibration system generally comprises a tank 103 having a lower tank portion 101 of essentially rectangular configuration and hollow vertical extensions 102 extending upwardly from respective of the four corners of the lower tank portions 101. Water as an anti-vibration medium fills up the entire volume of the lower tank portion 101 and further fills the hollow vertical extensions 102 for approximately half of their heights with upper air containing spaces maintained thereabove. The air containing spaces of respectively adjacent hollow vertical extensions 102 are communicated through four ducts 105. At intermediate portions of the four ducts, intermediate tank portions 106 are defined. The intermediate tank portions 106 are filled with water to a level substantially equal to the level of water in the hollow vertical extensions 102.

Partitioning plate 107 depending from the ceilings of the intermediate tank portions 106 extend into the interior space of each intermediate tank for dividing the upper portion of the interior space of the intermediate tank, thereby defining substantially U-shaped water communication paths. Rotary shafts 108 are rotatably mounted on the lower ends of respective partitioning plate 107 in horizontal orientation along the lower edges of the partitioning plates. Pivotal plates 109 are secured on the rotary shafts 108 for pivotal movement with the rotary shafts in response to flow of the water contained in the intermediate tank portions 106. Coil springs 110 are provided between the partitioning plates 107 and the rotary shafts 108. The coil springs 110 exert a biasing spring force to rotary shafts 108 for restricting rotary motion thereof and thereby restricting pivotal motion of the pivotal plates 109. By appropriately adjusting the spring coefficients of the coil springs 110, resistance against pivotal motion of the pivotal plates 109 can be adjusted depending upon the natural period (natural frequency) of the construction of which vibration is to be suppressed.

The hydrostatic anti-vibration system is installed on the roof or top of the construction. According to vibration induced on the construction, the water in the tank 103 causes rocking motion. In this rocking motion, due to inertia moments of the water, water collides on the interior walls of the tank 103 with a delay to the natural period or vibratory phase of the vibration of the construction. According to the rocking motion of water in the tank 103, the water level in each hollow vertical extension 102 is varied, thus increasing or decreasing the air pressure therein. Variation of the air pressure in the air containing spaces of two adjacent of the hollow vertical extensions 102 is introduced to opposite sides of the substantially U-shaped water flow path in the respective intermediate tank portion 106, thus causing rocking water flow in such intermediate tank portion 106 along such U-shaped flow path. Against the water flow thus induced, the spring biased pivotal plate 109 serves to provide resistance. This resistance cancels vibratory energy of the construction. With the construction set forth above, high anti-vibration effect can be attained for horizontal bi-directional vibration with a relatively small size of the tank. Furthermore, such hydrostatic anti-vibration system is advantageous in comparison with a pendulum type anti-vibration system by requiring no externally exposed mechanically movable component. Furthermore, the tank may serve as a reservoir for drinking water in the case of emergency.

In the case where such anti-vibration system is desired to operate as a hybrid type anti-vibration system by adding an active driving device for a passive type operation system for suppressing vibration of the construction more effectively, it becomes necessary to make the natural frequency of the anti-vibration system consistent with the natural period of the construction. In practical implementation, the natural frequency of the hydrostatic anti-vibration may be determined on the basis of an approximated value of the natural period of the construction derived from calculation of construction of the primary body thereof. Then, on the basis of such natural frequency, the dimensions and volume of the tank, the amount of water to be filled and so forth are designed for the anti-vibration system. The anti-vibration system is thus constructed on the roof or in the vicinity of the top of the construction, according to the design thereof.

However, certain features of such prior proposed hydrostatic anti-vibration system need to be improved. Namely, in the construction set forth above, since the hollow vertical extensions 102 are provided at the four corners of the lower tank portion 101 and four intermediate tanks 106 are provided for communicating between the four hollow vertical extensions, the construction is complicated. Furthermore, it is possible to cause disturbance of the flow of the water by horizontal bi-directional composite vibrations.

Also, since in such prior proposed construction the respective upper spaces of the intermediate tank portions 106 separated by the partitioning plates 107 are communicated with respective corresponding adjacent air containing spaces of the hollow vertical extensions 102, when a fluid force is generated in the direction indicated by the arrow in FIG. 8, for example, compression of the air is caused at the air containing space of one of the hollow vertical extensions 102 (left side in the illustrated case). Compressed air is then introduced into the communicated side of the upper space of the intermediate tank portion 106. The air pressure thus introduced can serve to suppress water flow in the intermediate tank portion 106 induced by the vibration of the construction. In such case, both fluid forces serve to cancel each other, thus causing the anti-vibration system to be not effective in suppressing vibration of the construction.

In addition, since water in the tank 103 and water in the intermediate tank portions 106 are separated completely, each such respective water portion has to be managed independently of the others, thus causing management of the water levels to be cumbersome. Furthermore, water in the hollow vertical portions 102 of the tank 103 and water in the intermediate tank portions 106 may flow from one to the other when large amplitude vibration occurs. In such case, the water levels in the hollow vertical extensions and in the intermediate tank portions can be varied to cause variation of the anti-vibration characteristics. Therefore, at every occasion of variation of the water levels in the hollow vertical extensions and in the intermediate tank portions, adjustment of the water levels becomes necessary to maintain the desired anti-vibration characteristics. Furthermore, the natural period of the construction varies delicately depending upon variation of the weight of the construction due to interior construction, modification of the construction design, changing of layout and so forth, in practice. Therefore, in the sense of high precision, the natural period of the construction cannot be determined until completion of construction. Furthermore, even after completion of construction, the weight of the construction and weight distribution therein are variable depending upon conditions of use of the construction. Such variation of the weight or weight distribution of the construction may cause variation of the natural period. Thereby, the natural frequency of the anti-vibration system, that is designed based on that of the construction, may be out of the effective range in terms of anti-vibration effect. As a solution for this, it may be possible to design the anti-vibration system for accommodating such future possible variation of the weight and/or weight distribution of the construction by adjustment of the water amount and the internal pressure in the tank. However, even with this measure, adjustment of the water amount and internal pressure is very troublesome in practice.

SUMMARY OF THE INVENTION

In view of the drawbacks in the prior proposal, it is a first object of the present invention to provide a hydrostatic anti-vibration system which is simplified in construction and has a greater ratio of the amount of water that is effective for an anti-vibrative effect against a vibration in the horizontal direction, relative to the overall amount of water in a tank.

A second object of the present invention is to provide a hydrostatic anti-vibration system which can avoid mutual cancellation of fluid forces, and wherein variation of air pressure due to fluid forces in the main tank and an intermediate tank are positively used for boosting the fluid force.

A third object of the present invention is to provide a hydrostatic anti-vibration system which can constantly maintain fluid levels in the main tank and the intermediate tank at the same level and thus can achieve high stability of anti-vibration characteristics.

A fourth object of the present invention is to provide a hydrostatic anti-vibration system which can facilitate fine adjustment of a natural frequency of the hydrostatic anti-vibration system depending upon a natural period (natural frequency) of a construction.

A fifth object of the present invention is to provide an adjusting method for a passive anti-vibration system which facilitates fine adjustment of the natural frequency of the system depending upon the actual natural period of the construction and which permits quick adjustment.

According to one aspect of the invention, a hydrostatic anti-vibration system comprises:

a main tank provided to be on a construction to be suppressed from vibration and having a main tank body of substantially flat rectangular configuration, and hollow vertical extensions extended upwardly from peripheral edge portions of the main tank body and filled with a working liquid at a predetermined level with upper air chambers maintained thereabove;

ducts communicating with the upper air chambers of the hollow vertical extensions;

intermediate tank portions connected to respective ducts and containing a vibration suppressing liquid;

a pivotal plate disposed in each of the intermediate tank portions for separating the interior space of such intermediate tank portion into a pair of chambers respectively connected to corresponding of the ducts, said plate pivoting in response to flow pressure of the vibration suppressing liquid;

a damper for providing a resistance against displacement of the pivotal plate; and an external adjusting mechanism associated with the damper for adjusting damping characteristics thereof and thereby adjusting the natural frequency of the anti-vibration system in relation to the natural frequency of the construction.

In the preferred construction, the intermediate tank portions are arranged outside of the main tank in parallel. Also, the ducts may be connected to the intermediate tank portion so that the arrangement of the pair of chambers separated by the pivotal plate may be in opposite phase to the arrangement of the upper air chambers of the vertical extensions connected thereto. In the alternative, the duct may be connected to the intermediate tank portion so that the arrangement of the pair of chambers separated by the pivotal plate may be in the same phase to the arrangement of the upper air chambers of the vertical extensions connected thereto.

The hydrostatic anti-vibration system may further comprise a conduit communicating the main tank body and each intermediate tank portion. Also, the hydrostatic anti-vibration system may further comprise as the adjusting mechanism a threaded shaft perpendicularly connected to a rotary shaft of the pivotal plate and a natural vibration frequency adjusting pendulum threadingly engaged to the threaded shaft for axial movement therealong.

According to another aspect of the invention, there is provided a method for adjusting a hydrostatic anti-vibration system including a main tank provided on a construction to be suppressed from vibration and having a main tank body of substantially flat rectangular configuration, and hollow vertical extensions extended upwardly from peripheral edge portions of the main tank body and filled with a working liquid at a predetermined level with upper air chambers thereabove, ducts connected to the upper air chambers of the hollow vertical extensions, intermediate tank portions connected to respective ducts and containing a vibration suppressing liquid, a pivotal plate disposed in each of the intermediate tank portions for separating the interior space thereof into a pair of chambers respectively connected to the corresponding ducts, the plate pivoting in response to flow pressure of the vibration suppressing liquid, and a damper for providing a resistance against displacement of the pivotal plate. The method comprises the steps of:

measuring an actual natural period of the construction to which the anti-vibration system is applied by vibration measuring equipment;

adjusting an external adjusting mechanism provided for the anti-vibration system for adjusting the natural vibration frequency of the anti-vibration system, depending upon the actual natural period of the construction measured by the vibration measuring equipment, to be consistent with the natural period of the construction.

Preferably, the method further comprising the steps of:

setting the natural frequency of the anti-vibration system depending upon a designed natural period of the construction before completion thereof;

adjusting the natural frequency of the anti-vibration system, after completion of construction to make the natural vibration frequency of the anti-vibration system to be consistent with the actual natural period of construction, by the external adjusting mechanism.

The external adjusting mechanism may include a threaded shaft perpendicularly connected to a rotary shaft of the pivotal plate and a natural vibration frequency adjusting pendulum threadingly engaged to the threaded shaft for axial movement therealong.

According to a further aspect of the invention, there is provided a hydrostatic anti-vibration system comprising:

a main container mounted on a top portion of a construction to which an anti-vibration effect is to be applied, and filled with a working liquid anti-vibration medium for converting vibration energy transmitted to the main container from the construction according to vibratory motion thereof, into a reciprocating flow of the working liquid anti-vibration medium in the main container for generating a vibratory counter force against the vibration force exerted on the construction;

two pairs of pneumatic chambers defined in upper portions of the main container, a first pair of the pneumatic chambers being arranged for causing pressure variation of pneumatic energy transmission medium therein in mutually opposite directions in response to reciprocating flow of the working liquid anti-vibration medium in a first direction, and second pair of the pneumatic chambers being arranged for causing pressure variation of pneumatic energy transmission medium therein in mutually opposite directions in response to reciprocating flow of the working liquid anti-vibration medium in a second direction perpendicular to the first direction and in a horizontal plane common therewith;

a first damping mechanism communicated with the first pair of pneumatic chambers for damping pressure variation in the first pair of pneumatic chambers and thereby damping reciprocating flow of the working liquid anti-vibration medium in the first direction;

a second damping mechanism communicated with the second pair of pneumatic chambers for damping pressure variation in the second pair of pneumatic chambers and thereby damping reciprocating flow of the working liquid anti-vibration medium in the second direction; and an external damping force adjusting mechanism provided externally to and cooperated with respective of the first and second damping mechanisms for determining damping characteristics thereof for adjustment of the natural frequency of the anti-vibration system to a natural frequency of the construction.

According to a still further aspect of the invention, a hydrostatic anti-vibration system comprises:

a main container mounted on a top portion of a construction to which anti-vibration effect is to be applied, and filled with a working liquid anti-vibration medium for converting vibration energy transmitted to the main container from the construction according to vibratory motion thereof into a reciprocating flow of the working liquid anti-vibration medium in the main container for generating a vibratory counter force against the vibration force exerted on the construction;

two pairs of pneumatic chambers defined in upper portions of the main container, a first pair of the pneumatic chambers being arranged for causing pressure variation of pneumatic energy transmission medium therein in mutually opposite directions in response to reciprocating flow of the working liquid anti-vibration medium in a first direction, and a second pair of the pneumatic chambers being arranged for causing pressure variation of pneumatic energy transmission medium therein in mutually opposite directions in response to reciprocating flow of the working liquid anti-vibration medium in a second direction perpendicular to the first direction and in common horizontal plane;

a first damping mechanism communicated with the first pair of pneumatic chambers for damping pressure variation in the first pair of pneumatic chambers and thereby damping reciprocating flow of the working liquid anti-vibration medium in the first direction;

a first phase reversing means for reversing a phase of pressure variation between the first pair of pneumatic chambers in the main container and the first damping mechanism for accommodating a working liquid anti-vibration medium originated pressure variation, thereby for avoiding influence thereof on the anti-vibration effect of the anti-vibration system;

a second damping mechanism communicated with the second pair of pneumatic chambers for damping pressure variation in the second pair of pneumatic chambers and thereby damping reciprocating flow of the working liquid anti-vibration medium in the second direction; and a second phase reversing means for reversing a phase of pressure variation between the second pair of pneumatic chambers in the main container and the second damping mechanism for accommodating a working liquid anti-vibration medium originated pressure variation, thereby for avoiding influence thereof on the anti-vibration effect of the anti-vibration system.

According to a yet further aspect of the invention, a hydrostatic anti-vibration system comprises:

a main container to be mounted on a top portion of a construction to which an anti-vibration effect is to be applied, and filled with a working liquid anti-vibration medium for converting vibration energy transmitted to the main container from the construction according to vibratory motion of the latter into a reciprocating flow of the working liquid anti-vibration medium in the main container for generating a vibratory counter force against the vibration force exerted on the construction;

two pairs of pneumatic chambers defined in upper portions of the main container, a first pair of the pneumatic chambers being arranged for causing pressure variation of pneumatic energy transmission medium therein in mutually opposite directions in response to reciprocating flow of the working liquid anti-vibration medium in a first direction, and a second pair of the pneumatic chambers being arranged for causing pressure variation of pneumatic energy transmission medium therein in mutually opposite directions in response to reciprocating flow of the working liquid anti-vibration medium in a second direction perpendicular to the first direction and in a common horizontal plane;

a first hydropneumatic damping mechanism communicated with the first pair of pneumatic chambers for damping pressure variation in the first pair of pneumatic chambers and thereby damping reciprocating flow of the working liquid anti-vibration medium in the first direction;

a second hydropneumatic damping mechanism communicated with the second pair of pneumatic chambers for damping pressure variation in the second pair of pneumatic chambers and thereby damping reciprocating flow of the working liquid anti-vibration medium in the second direction; and conduit means for establishing a limited flow rate of communication of the working liquid anti-vibration medium between the main container and the first and second hydropneumatic damping mechanisms.

According to a still further aspect of the invention, a hydrostatic anti-vibration system comprises:

a main container to be mounted on a top portion of a construction to which anti-vibration effect is to be applied, and filled with a working liquid anti-vibration medium for converting vibration energy transmitted to the main container from the construction according to vibratory motion of the latter into a reciprocating flow of the working liquid anti-vibration medium in the main container for generating a vibratory counter force against the vibration force exerted on the construction;

two pairs of pneumatic chambers defined in upper portions of the main container, a first pair of the pneumatic chambers being arranged for causing pressure variation of pneumatic energy transmission medium in mutually opposite directions in response to reciprocating flow of the working liquid anti-vibration medium in a first direction, and a second pair of the pneumatic chambers being arranged for causing pressure variation of pneumatic energy transmission medium therein in mutually opposite directions in response to reciprocating flow of the working liquid anti-vibration medium in a second direction perpendicular to the first direction and in a common horizontal plane;

a first damping mechanism communicated with the first pair of pneumatic chambers for damping pressure variation in the first pair of pneumatic chambers and thereby damping reciprocating flow of the working liquid anti-vibration medium in the first direction;

first phase reversing means for reversing a phase of pressure variation between the first pair of pneumatic chambers in the main container and the first damping mechanism for accommodating a working liquid anti-vibration medium originated pressure variation, thereby avoiding influence thereof on the anti-vibration effect of the anti-vibration system;

a second damping mechanism communicated with the second pair of pneumatic chambers for damping pressure variation in the second pair of pneumatic chambers and thereby damping reciprocating flow of the working liquid anti-vibration medium in the second direction;

second phase reversing means for reversing a phase of pressure variation between the second pair of pneumatic chambers in the main container and the second damping mechanism for accommodating a working liquid anti-vibration medium originated pressure variation, thereby avoiding influence thereof on the anti-vibration effect of the anti-vibration system; and an external damping force adjusting mechanism provided externally to and cooperated with respective of the first and second damping mechanisms for determining damping characteristics thereof for adjustment of the natural frequency of the anti-vibration system to a natural frequency of the construction.

According to a further aspect of the invention, a hydrostatic anti-vibration system comprises:

a main container to be mounted on a top portion of a construction to which an anti-vibration effect is to be applied, and filled with a working liquid anti-vibration medium for converting vibration energy transmitted to the main container from the construction according to vibratory motion of the latter into a reciprocating flow of the working liquid anti-vibration medium in the main container for generating a vibratory counter force against the vibration force exerted on the construction;

two pairs of pneumatic chambers defined in upper portions of the main container, a first pair of the pneumatic chambers being arranged for causing pressure variation of pneumatic energy transmission medium therein in mutually opposite directions in response to reciprocating flow of the working liquid anti-vibration medium in a first direction, and a second pair of the pneumatic chambers being arranged for causing pressure variation of pneumatic energy transmission medium therein in mutually opposite directions in response to reciprocating flow of the working liquid anti-vibration medium in a second direction perpendicular to the first direction and in a common horizontal plane;

a first hydropneumatic damping mechanism communicated with the first pair of pneumatic chambers for damping pressure variation in the first pair of pneumatic chambers and thereby damping reciprocating flow of the working liquid anti-vibration medium in the first direction;

first phase reversing means for reversing a phase of pressure variation between the first pair of pneumatic chambers in the main container and the first damping mechanism for accommodating a working liquid anti-vibration medium originated pressure variation, thereby avoiding influence thereof for anti-vibration effect of the anti-vibration system;

a second hydropneumatic damping mechanism communicated with the second pair of pneumatic chambers for damping pressure variation in the second pair of pneumatic chambers and thereby damping reciprocating flow of the working liquid anti-vibration medium in the second direction;

second phase reversing means for reversing a phase of pressure variation between the second pair of pneumatic chambers in the main container and the second damping mechanism for accommodating a working liquid anti-vibration medium originated pressure variation, thereby avoiding influence thereof on the anti-vibration effect of the anti-vibration system; and conduit means for establishing a limited flow rate of communication of the working liquid anti-vibration medium between the main container and the first and second hydropneumatic damping mechanisms.

According to a yet further aspect of the invention, a hydrostatic anti-vibration system comprises:

a main container to be mounted on a top portion of a construction to which an anti-vibration effect is to be applied, and filled with a working liquid anti-vibration medium for converting vibration energy transmitted to the main container from the construction according to vibratory motion of the latter into a reciprocating flow of the working liquid anti-vibration medium in the main container for generating a vibratory counter force against the vibration force exerted on the construction;

two pairs of pneumatic chambers defined in upper portions of the main container, a first pair of the pneumatic chambers being arranged for causing pressure variation of pneumatic energy transmission medium therein in mutually opposite directions in response to reciprocating flow of the working liquid anti-vibration medium in a first direction, and a second pair of the pneumatic chambers being arranged for causing pressure variation of pneumatic energy transmission medium therein in mutually opposite directions in response to reciprocating flow of the working liquid anti-vibration medium in a second direction perpendicular to the first direction on a common horizontal plane;

a first hydropneumatic damping mechanism communicated with the first pair of pneumatic chambers for damping pressure variation in the first pair of pneumatic chambers and thereby damping reciprocating flow of the working liquid anti-vibration medium in the first direction;

first phase reversing means for reversing a phase of pressure variation between the first pair of pneumatic chambers in the main container and the first damping mechanism for accommodating a working liquid anti-vibration medium originated pressure variation, thereby avoiding influence thereof on the anti-vibration effect of the anti-vibration system;

a second hydropneumatic damping mechanism communicated with the second pair of pneumatic chambers for damping pressure variation in the second pair of pneumatic chambers and thereby damping reciprocating flow of the working liquid anti-vibration medium in the second direction;

second phase reversing means for reversing a phase of pressure variation between the second pair of pneumatic chambers in the main container and the second damping mechanism for accommodating a working liquid anti-vibration medium originated pressure variation, thereby avoiding influence thereof on the anti-vibration effect of the anti-vibration system;

an external damping force adjusting mechanism provided externally to and cooperated with respective of the first and second damping mechanisms for determining damping characteristics thereof for adjustment of the natural frequency of the anti-vibration system to a natural frequency of the construction; and conduit means for establishing a limited flow rate of communication of the working liquid anti-vibration medium between the main container and the first and second hydropneumatic damping mechanisms.

BRIEF DESCRIPTION OF THE DRAWINGS

The present invention will be understood more fully from the detailed description given, herebelow and from the accompanying drawings of preferred embodiments of the invention, which, however, should not be taken to be limiting to the invention, but are for explanation and understanding only.

In the drawings.

DESCRIPTION OF PREFERRED EMBODIMENTS

The preferred embodiments of the present invention will be discussed hereinafter in detail with reference to FIG. 1A to FIG. 7. In the following description, numerous specific details are set forth in order to provide a thorough understanding of the present invention. It will be obvious, however, to those skilled in the art that the present invention may be practiced without these specific details. In other instances, well-known structures are not shown in detail in order to not unnecessarily obscure the present invention.

First Embodiment

Figure 1A:
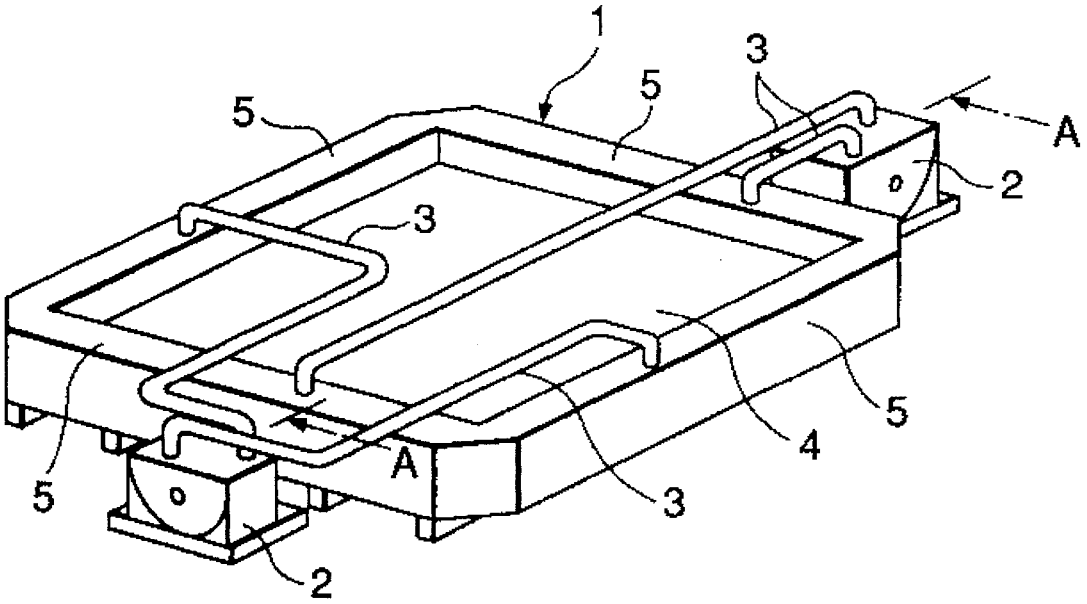
FIG. 1A is a perspective view of a first embodiment of a hydrostatic anti-vibration system according to the present invention.
Figure 1B:
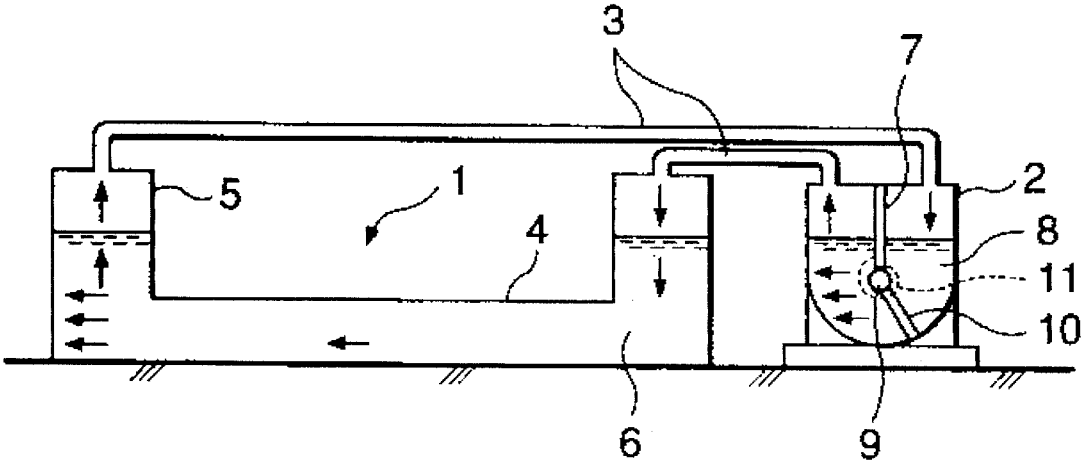
FIG. 1B is a section taken along line A—A of FIG. 1A.

FIGS. 1A and 1B show the first embodiment of a hydrostatic anti-vibration system according to the present invention. The anti-vibration system includes a main tank 1 and a pair of intermediate tank portions 2 which are arranged in opposition to each other across the main tank 1. Each of the intermediate tank portions 2 is communicated with the main tank 1 via a respective pair of communication ducts 3.

The main tank 1 comprises a flat rectangular main tank body 4 and a hollow vertical extension 5 upwardly extended from the peripheral edge of the main tank body 4 and extending throughout the entire periphery thereof. Therefore, the main tank 1 is constructed in generally rectangular or dish-shaped configuration with a recessed central portion. The tank 1 is adapted to be installed on the roof or top or so forth of a construction or building. Water 6 as a working fluid or anti-vibration medium fills the entire interior space of the main tank, body 4 and is further filled to an intermediate height level of the vertical extension 5. Respective pairs of portions of the vertical extension 5 positioned in opposition to each other are adapted to serve for suppression of vibration exerted in respective directions perpendicular to the longitudinal directions thereof. Therefore, one pair of portions of the vertical extension 5 suppresses vibrations in rearward and forward horizontal directions, and the other pair suppresses vibrations in left and right horizontal directions. Adjacent portions of the vertical extension 5 are blocked from communication to each other so that the action of the water for suppressing vibration in one horizontal direction will not affect suppression of vibration in the other horizontal direction. Respective portions of the vertical extension 5 are closed at the top. Each pair of the portions of the vertical extension 5 are communicated with one of the intermediate tank portions 2 via the respective pair of communication ducts 3 with respective hydropneumatic damping mechanisms described below.

Each intermediate tank portion 2 is an enclosed tank with a rounded lower half. A partitioning plate 7 is disposed within the interior space of the intermediate tank portion 2 depending from the ceiling thereof at the center portion so that a substantially U-shaped water flow path is defined in the intermediate tank portion. Water 8 is filled in the intermediate tank portion 2 to a level high than the lower end of the partitioning plate 7. A rotary shaft 9 is rotatably supported at the lower end of the partitioning plate 7 to extend horizontally. The rotary shaft 9 is rigidly connected to a pivotal plate 10 for pivotal movement within the rounded lower half of the intermediate tank portion 2. The pivotal plate 10 thus constructed pivots in response to flowing motion of water 8 induced by vibration of the construction. The rotary shaft 9 extends from the intermediate tank portion 2. A coil spring 11 is disposed between the extended end of the rotary shaft 9 and the stationary wall of the intermediate tank portion 2 and forms a damper for exerting a spring force for providing a resistance against rotary motion of the rotary shaft 9.

Figure 2A:
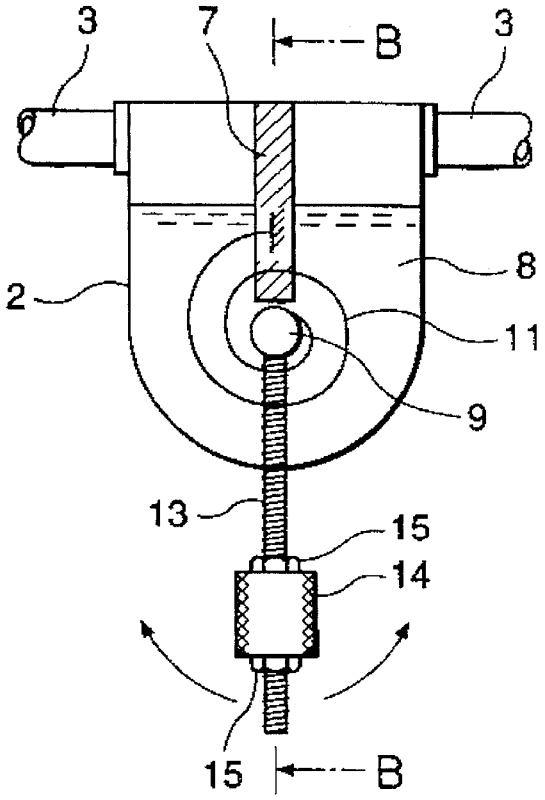
FIG. 2A is a partial enlarged section of the first embodiment of the hydrostatic anti-vibration system of FIG. 1B.
Figure 2B:
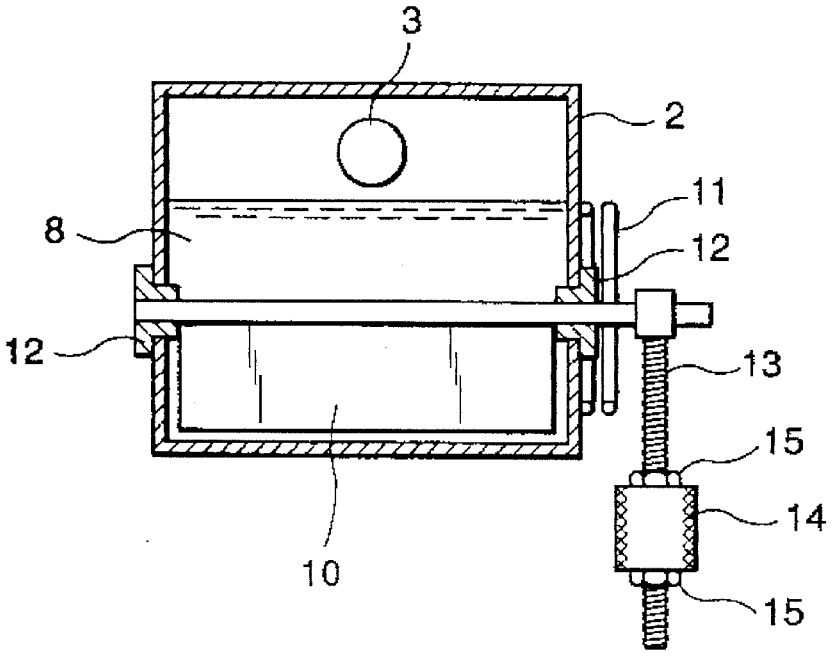
FIG. 2B is a section taken along line B—B of FIG. 2A.

As shown in FIGS. 2A and 2B, the rotary shaft 9 is rotationally supported by water tight seal bearings 12 provided at both sides of the intermediate tank portion 2. To the extended end of the rotary shaft 9 positioned outside of the intermediate tank portion 2 is connected a threaded shaft 13 to depend perpendicularly from the rotary shaft 9. The threaded shaft 13 carries a pendulum 14 which provides a rotational inertia moment and a restoration force toward an initial position. The pendulum 14 is threadingly movable along the threaded shaft 13 for varying a lever ratio and thereby varying the natural frequency. Fastening nuts 15 are provided at both axial ends of the pendulum 14. With this construction, at a stable condition, the threaded shaft 13 vertically depends from the rotary shaft 9 due to the mass weight of the pendulum 14 to situate the pivotal plate 10 at a position vertically depending from the rotary shaft 9. This position of the pivotal plate 10 hereafter will be referred to as the neutral position. When a vibration is caused in the construction or building, a rocking motion is imparted to water 6 and 8 in the main tank 1 and the intermediate tank portions 2. A force thus is exerted on the pivotal plates 10 due to energy of flowing water, thereby to cause pivotal movement of plates 10. The vibration frequency of each pivotal plate 10 is determined by a combination of the spring coefficient of the respective coil spring 11 and the rotational inertia force and restoration force to be induced by the respective pendulum 14. This further determines the vibration frequency of the overall anti-vibration system.

Namely, the inertia moment to be generated on the pendulum 14 is variable depending upon the axial position thereof on the threaded shaft 13. The inertia force thus generated by the pendulum is combined with the resistance against rotation of the rotary shaft 9 exerted by the coil spring 11. For instance, when the pendulum 14 is positioned close to the rotary shaft 9, the rotational inertia moment become smaller so that the resistance against rotation of the rotary shaft 9 becomes smaller, and when the pendulum 14 is positioned away from the rotary shaft 9, the rotational inertial moment of the pendulum becomes greater to provide greater resistance against rotation of the rotary shaft 9. The natural frequency is variable depending upon the resistance against the rotation of the rotary shaft 9.

The ducts 3 are connected to mutually opposing portions of the vertical extension 5. Thus, the phases of rocking motion of the water flow between the associated pairs of the portions of the vertical extension 5 are mutually opposite. By the arrangement of the ducts 3 illustrated in FIG. 1B, as shown by the arrows, the direction of the fluid force of water and the direction of compression of air is serial throughout the system, including through the substantially U-shaped flow path in the intermediate tank portion. Therefore, cancellation of the fluid forces due to opposite phases of action, as occur in the prior art, can be successfully avoided. Furthermore, since motion of water portions 6 and 8 in the main tank 1 and in the intermediate tank portion 2 are synchronized with each other, a high anti-vibration effect can be achieved with a small size system. Also, since the vertically extending portion 5 is communicated to the main tank body 4 along the peripheral edges of the latter in mutually blocked fashion, flow of water 6 will be smooth so that a large proportion of water 6 in the tank 1 will contribute to the anti-vibration effect, even though the overall amount of water contained in the main tank 1 is small. Therefore, the same magnitude of anti-vibration effect can be attained with smaller tank size, in comparison with the prior art.

Figure 3:
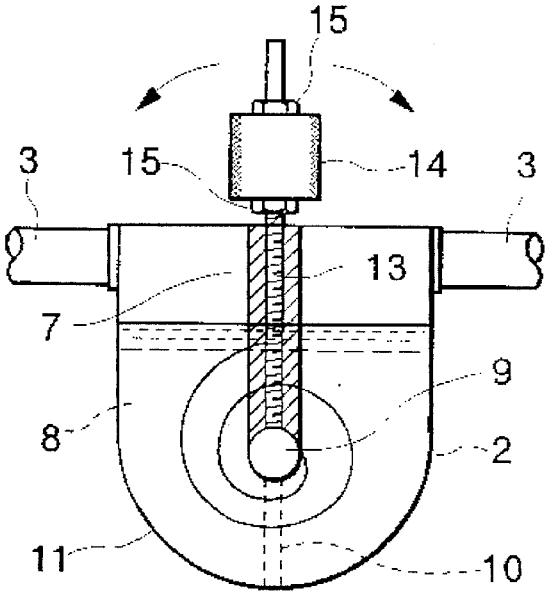
FIG. 3 is a section similar to FIG. 2A but showing a modification of the first embodiment of the hydrostatic anti-vibration system according to the invention.

FIG. 3 shows a modification of the foregoing first embodiment of the hydrostatic anti-vibration system according to the invention. In this modification, the rotational inertial moment and the restoration force to be applied by the pendulum 14 acts in a direction opposite to the direction of the spring force of the coil spring 11. The threaded shaft 13 is extended vertically upwardly from the extending end of the rotary shaft 9. The pendulum 14 is engaged to the threaded shaft 13 for axial threading adjusted movement therealong. Opposite axial ends of the pendulum 14 are fixed by fastening nuts 15. The inertia force and restoration force to be generated by the pendulum at the occurrence of vibration is opposite to the direction of the spring force of the coil spring 11. Therefore, such construction will permit adjustment of the vibration frequency of the system by shifting the pendulum 14 along the threaded shaft 13, and thereby adjusting the counter force against the spring force.

Discussion now will be made of the manner of adjustment of the anti-vibration system constructed as set forth above. Initially, in the condition where the pendulum 14 is removed from the threaded shaft 13, a vibration of the overall construction or building is measured in the per se known manner by means of not shown vibration measuring equipment. The measuring equipment can detect fine vibration (normal fine vibration) caused by wind or so forth even when no substantial vibration due to earthquake and so forth occurs. Since the measured vibration period is equal to the natural period of the entire construction, the natural period can be measured at any time.

Subsequently, the pendulum 14 is mounted on the threaded shaft 13 and positioned at a position closest to the rotary shaft 9. Then, by manually swinging the threaded shaft 13 for free swinging motion, the vibration period is again measured. Then, by shifting the axial position of the pendulum 14 by threadingly shifting the fastening nuts 15, measurement of the vibration period is measured repeatedly at different axial positions of the pendulum 14. Thus, the axial position of the pendulum 14, where synchronization of the pivotal motion of the pivotal plate 10 to the natural period of the construction, can be established. Then, at the synchronized position, it is confirmed with a vibration gauge positioned at the top end of the construction or building that the amplitude of the vibration of the construction becomes minimum. Then, the pendulum 14 is fixed at the axial position where synchronization is established by tightening the fastening nuts 15. In addition, when the length of the threaded shaft 13 is not enough to adjust the vibration period, a different weight of pendulum 14 may be used so that synchronization can be established within a range of the adjustable stroke of the threaded shaft 13.

As set forth above, according to the embodiment constructed as set forth above, water 6 collides on a wall of the tank 1 with a delay to the natural period or vibratory phase of the vibration of the construction. According to rocking motion of water in the tank 1, the water level in each hollow portion of vertical extension 5 is varied to increase or decrease the air pressure therein. Variation of the air pressure at each air containing space of each portion of the hollow vertical extension 5 is introduced at both sides of the substantially U-shaped water flow path in the respective intermediate tank portion 2 to cause rocking water flow along the U-shaped flow path thereof. Against the water flow thus induced, the spring biased pivotal plate 10 serves to provide resistance. This resistance cancels vibratory energy of the construction. With the construction set forth above, a high anti-vibration effect can be attained for horizontal bi-directional vibration with a relatively small size of the tank.

Furthermore, the displacement characteristics or flow resistance characteristics of the pivotal plate 10 can be easily adjusted by varying the axial position of the pendulum 14 or by adjusting the spring coefficient of the coil spring 11. By adjustment of the displacement characteristics of the pivotal plate 10, the anti-vibration characteristics of the overall system can be synchronized with the natural frequency of the construction or the building. Also, the intermediate tank portions 2 can be placed at any arbitrary positions. Furthermore, since the intermediate tank portion 2 can be placed outside of the main tank, adjustment of the flow resistance for the rotary plate 10 can be facilitated. In addition, since two intermediate tank portions 2 are employed for obtaining anti-vibration effect for two horizontal directions, the construction of the anti-vibration system can be simplified. Furthermore, since adjustment of the anti-vibration characteristics against one direction of horizontal vibration can be done by adjusting only one portion, adjustment of the characteristics adapting to the vibration characteristics of the construction or building becomes easier.

It will be appreciated that, while the coil spring 11 is a primary element for producing resistance against pivotal movement of the pivotal plate 10 and the pendulum 14 is employed as an element for adjusting the anti-vibration characteristics, it is possible to employ only pendulum 14 for producing the resistance against pivotal movement of the pivotal plate 10 and for adjustment of the anti-vibration characteristics. Also, while the resistance against pivotal motion of the pivotal plate 10 is provided by the coil spring 11, it is possible that the pivotal plate can be coupled with an active drive such as a motor, hydraulic actuator and so forth for actively suppressing vibration of the construction.

Second Embodiment

Next, discussion will be made of the second embodiment of the hydrostatic anti-vibration system according to the present invention. It should be noted that like reference numerals to the foregoing first embodiment denote like elements.

Figure 4:
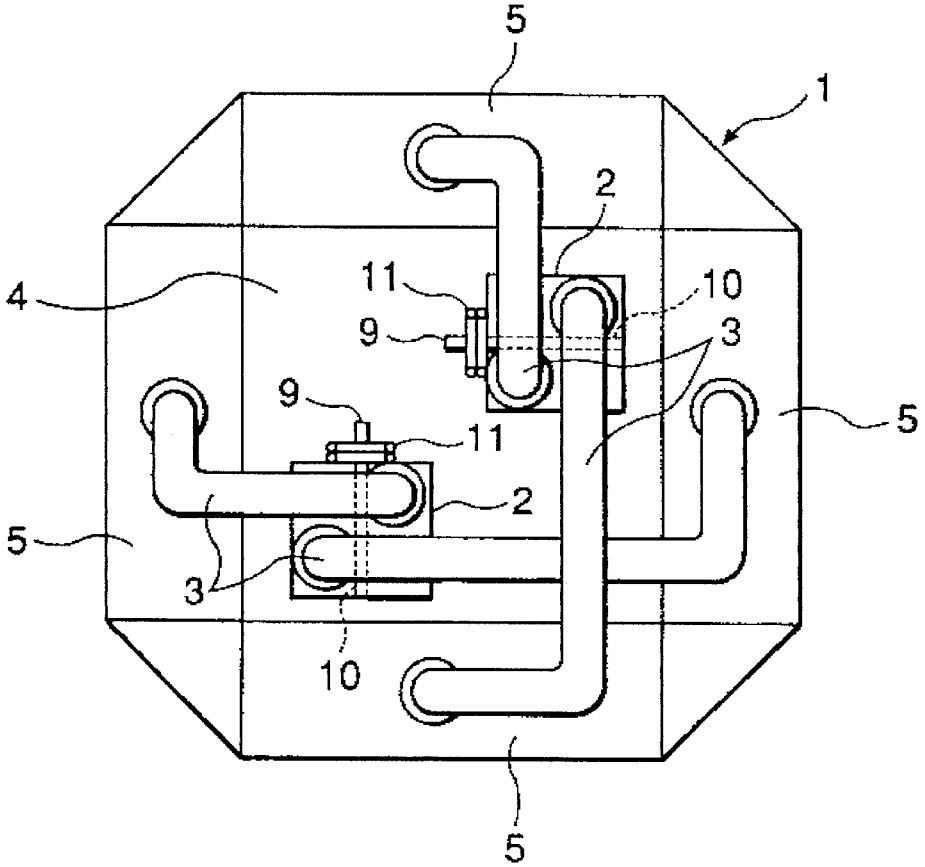
FIG. 4 is a plan view of a second embodiment of the hydrostatic anti-vibration system according to the present invention.

As shown in FIG. 4, two intermediate tank portions 2 are positioned in the recessed central portion of the main tank body 4 surrounded by the vertical extension 5. Two spaces defined in each intermediate tank portion 2 by the respective partitioning plate 7 are communicated with respective mutually opposing portions of the vertical extension 5 through ducts 3 to cause fluid flow in reversed phases. Therefore, the fluid forces in two spaces of one intermediate tank portion 2 are opposite in phase to the adjacent portions of the vertical extension 5, thereby certainly avoiding mutual cancellation. Since the intermediate tank portions 2 are arranged on the main tank body 4, the length of the ducts 3 can be shortened and the overall size of the anti-vibration system can be made smaller.

Third Embodiment

Figure 5:
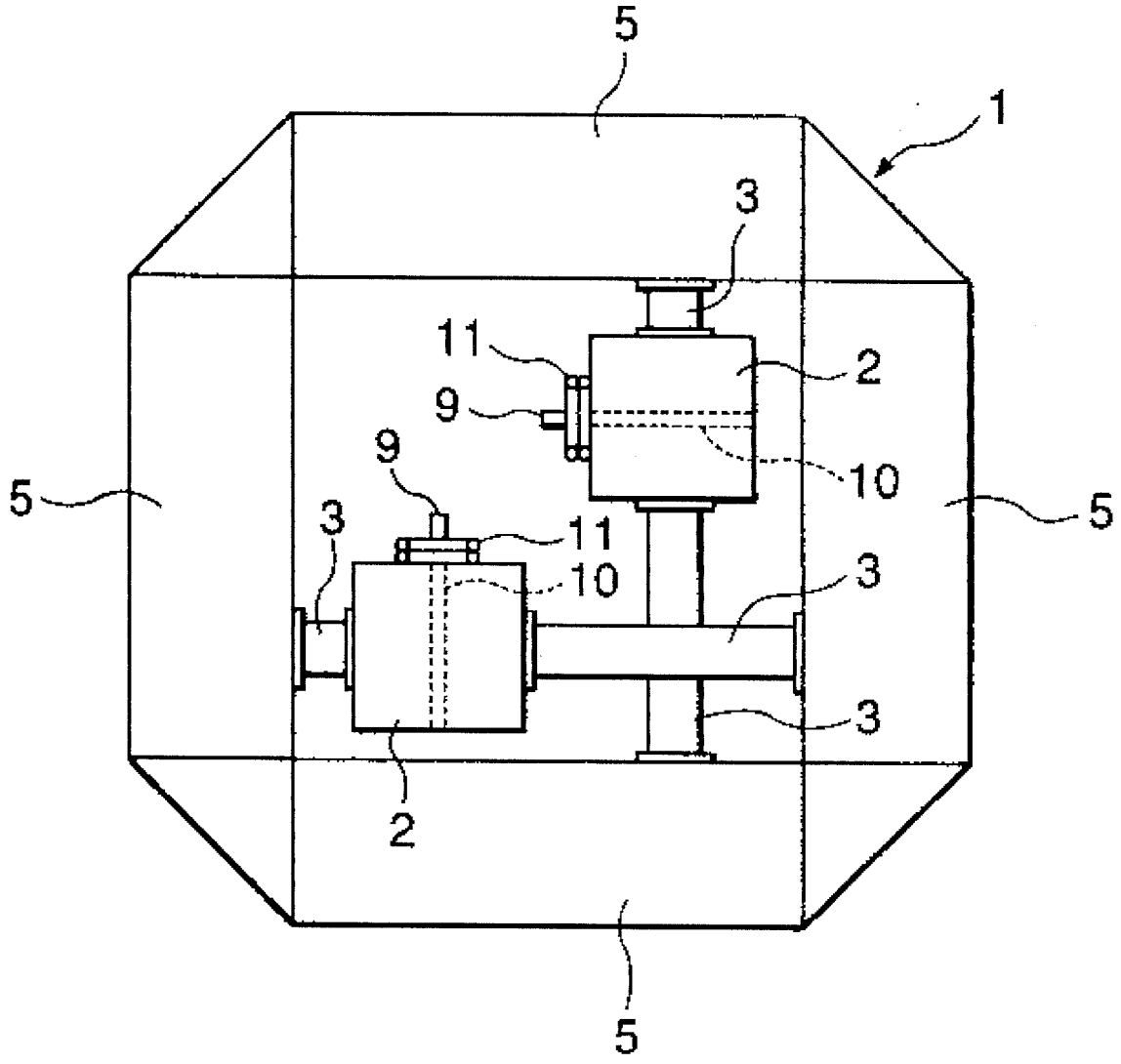
FIG. 5 is a plan view of a third embodiment of the hydrostatic anti-vibration system according to the present invention.

FIG. 5 shows the third embodiment of the hydrostatic anti-vibration system according to the present invention. Two spaces defined in each intermediate tank portion 2 by the respective partitioning plate 7 are communicated with respective mutually opposing portions of the vertical extension 5 through the ducts 3 to cause fluid flow in the same phase.

Fourth Embodiment

Figure 6A:
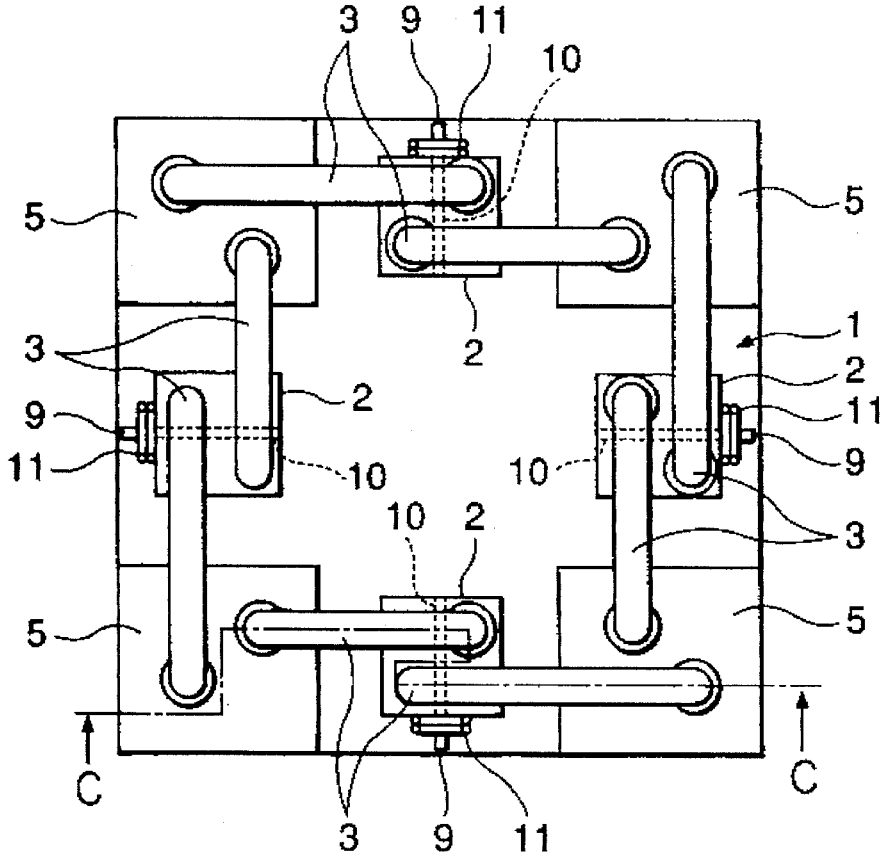
FIG. 6A is a plan view of the fourth embodiment of the hydrostatic anti-vibration system according to the present invention.
Figure 6B:
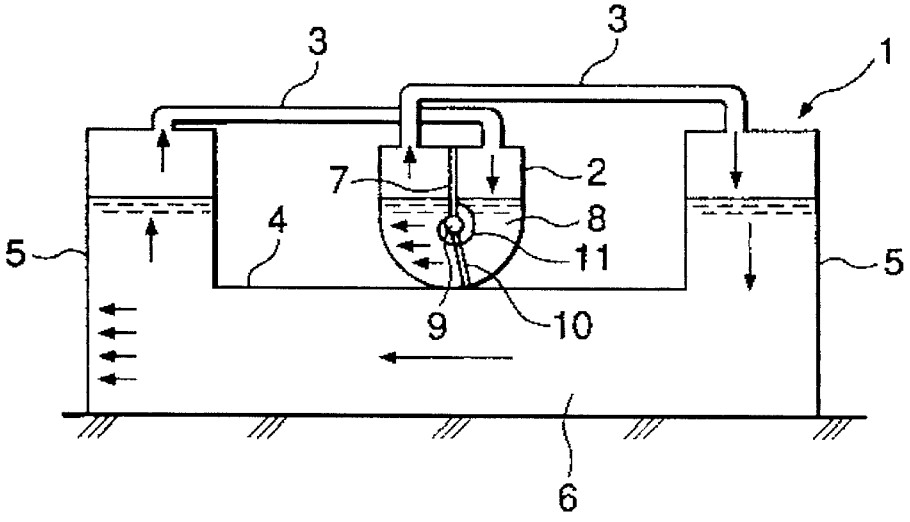
FIG. 6B is a section taken along line C—C of FIG. 6A.

FIGS. 6A and 6B show the fourth embodiment of the hydrostatic anti-vibration system according to the invention. Four vertical extensions 5 are provided at respective four corners of the main tank body 4 in communication with the latter. Four intermediate tank portions 2 are provided between adjacent vertical extensions 5.

Fifth Embodiment

Figure 7:
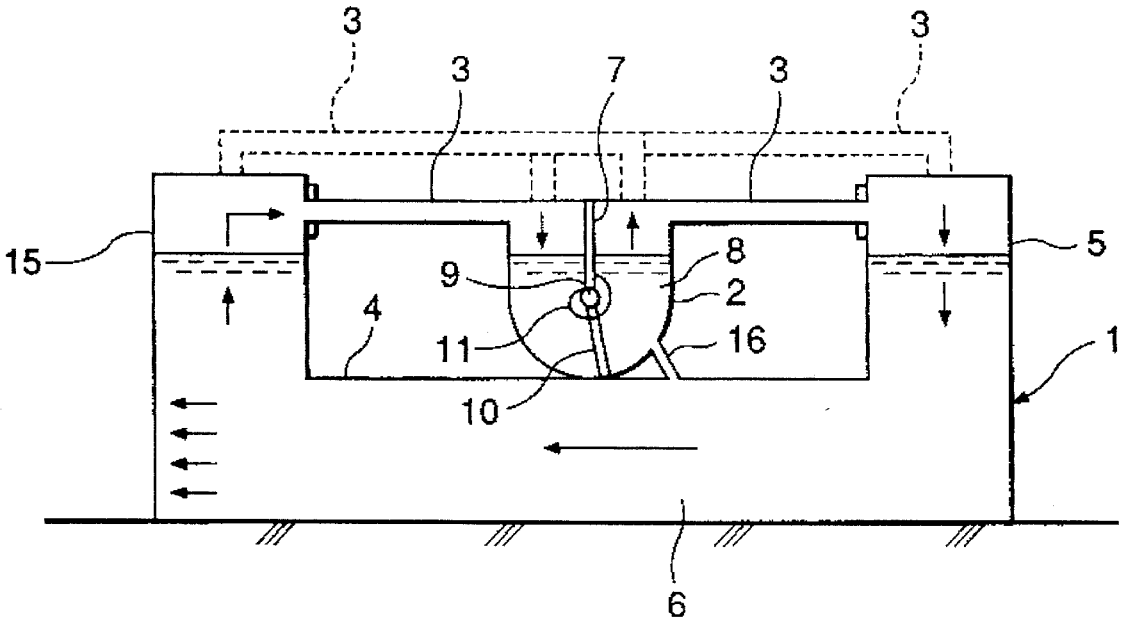
FIG. 7 is a plan view of the fifth embodiment of the hydrostatic anti-vibration system according to the present invention.
Figure 8:
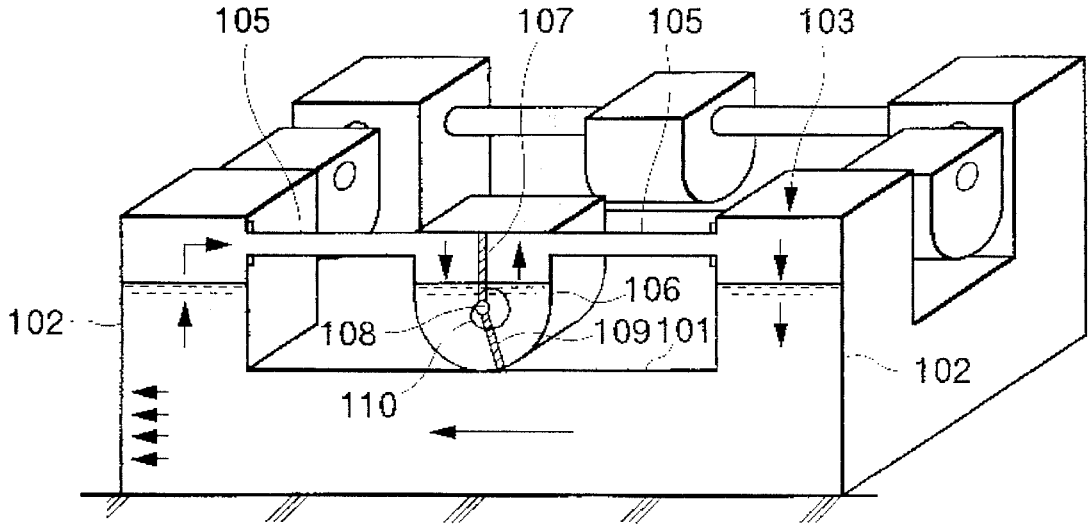
FIG.8 PRIOR ART
FIG. 8 is a sectional side elevation of the conventional hydrostatic anti-vibration system.

FIG. 7 shows the fifth embodiment of the hydrostatic anti-vibration system according to the invention. The bottom of the intermediate tank portion 2 and the main tank body 4 are communicated through a conduit 16 so that the water levels in the vertical extensions 5 and in the intermediate tank portion 2 are constantly maintained equal. The diameter of the conduit 16 is selected in such a manner that the water levels in the vertical extensions 5 and in the intermediate tank portion 2 are equal in the static state, but that the anti-vibration effect will not be affected, the small diameter of the conduit 16 provides sufficient water flow restriction. Even when water flows through the ducts 3 between the main tank body 4 and the intermediate tank portions 2 to cause a difference of the water levels due to large amplitude vibration, water will flow through the conduit 16 to gradually equalize the water levels. With this construction, it becomes unnecessary to manage the water levels in the main tank body 4 and in the intermediate tank portions 5 to maintain then at equal level. It should be appreciated that the connection between the vertical extensions 5 and two spaces defined in the respective intermediate tank portion 2 may be established in equal phase (as shown by solid lines) or in reverse phase (as shown by broken lines).

Although the invention has been illustrated and described with respect to exemplary embodiments thereof, it will be understood by those skilled in the art that the foregoing and various other changes, omissions and additions may be made therein and thereto without departing from the spirit and scope of the present invention. Therefore, the present invention should not be understood as limited to the specific embodiments set forth above but to include all possible embodiments which can be embodied within a scope encompassed and equivalents thereof with respect to the feature set forth in the appended claims.

What is claimed is:

1. A hydrostatic anti-vibration system comprising:

a main tank to be provided on a construction to be suppressed from vibrating and having a main tank body of substantially flat rectangular configuration, and hollow vertical extensions extended upwardly from peripheral edge portions of said main tank body and filled with a working liquid to a predetermined level with upper air chambers maintained thereabove;

ducts communicating with said upper air chambers of said hollow vertical extensions;

intermediate tank portions connected to respective pairs of said ducts and containing a vibration suppressing liquid;

a pivotal plate disposed in each said intermediate tank portion and separating an interior space thereof into a pair of chambers connected to respective said ducts, said pivotal plate pivoting in response to flow pressure of said vibration suppressing liquid;

a damper providing a resistance against displacement of said pivotal plate; and an external mechanism associated with said damper for adjusting damping characteristics thereof and thereby adjusting the natural frequency of said anti-vibration system in relation to the natural frequency of the construction.

2. A hydrostatic anti-vibration system as set forth in claim 1, wherein said intermediate tank portions are arranged outside of said main tank in parallel.

3. A hydrostatic anti-vibration system as set forth in claim 1, wherein said pair of ducts of each said intermediate tank portion are connected thereto so that the arrangement of said pair of chambers thereof is opposite in phase to the arrangement of said upper air chambers of said vertical extensions connected thereto.

4. A hydrostatic anti-vibration system as set forth in claim 1, wherein said pair of ducts of each said intermediate tank portion are connected thereto so that the arrangement of said pair of chambers thereof is in phase to the arrangement of said upper air chambers of said vertical extensions connected thereto.

5. A hydrostatic anti-vibration system as set forth in claim 1, further comprising a conduit communicating said main tank body and each said intermediate tank portion.

6. A hydrostatic anti-vibration system as set forth in claim 1, wherein said external mechanism comprises a threaded shaft perpendicularly connected to a rotary shaft of said pivotal plate, and a natural vibration frequency adjusting pendulum threadingly engaged to said threaded shaft for axial movement therealong.

7. A method for adjusting a hydrostatic anti-vibration system including a main tank provided on a construction to be suppressed from vibrating and having a main tank body of substantially flat rectangular configuration, and hollow vertical extensions extended upwardly from peripheral edge portions of said main tank body and filled with a working liquid at a predetermined level with upper air chambers maintained thereabove, ducts communicating with said upper air chambers of said hollow vertical extensions, intermediate tank portions connected to respective pairs of said ducts and containing a vibration suppressing liquid, a pivotal plate disposed in each said intermediate tank portion and separating an interior space thereof into a pair of chambers connected to respective said ducts, said pivot plate pivoting in response to flow pressure of said vibration suppressing liquid, and a damper providing a resistance against displacement of said pivotal plate, said method comprising the steps of:

measuring an actual natural period of said construction by vibration measuring equipment;

adjusting an external adjusting mechanism provided for said anti-vibration system, and adjusting the natural vibration frequency of said anti-vibration system, depending upon said actual natural period of said construction measured by said vibration measuring equipment, to be consistent with said natural period of said construction.

8. A method for adjusting a hydrostatic anti-vibration system as set forth in claim 7, further comprising the steps of:

setting the natural frequency of said anti-vibration system depending upon a designed natural period of said construction before completion thereof;

adjusting said natural frequency of said anti-vibration system, after completion of said construction to make said natural vibration frequency of said anti-vibration system consistent with said actual natural period of said construction, by said external adjusting mechanism.

9. A method for adjusting a hydrostatic anti-vibration system as set forth in claim 7, wherein said external adjusting mechanism comprises a threaded shaft perpendicularly connected to a rotary shaft of said pivotal plate and a natural vibration frequency adjusting pendulum threadingly engaged to said threaded shaft for axial movement therealong.

10. A hydrostatic anti-vibration system comprising:

a main container to be mounted on a top portion of a construction to which an anti-vibration effect is to be applied, said main container being filled with a working liquid anti-vibration medium for converting vibration energy transmitted to said main container from the construction according to vibratory motion thereof into a reciprocating flow of said working liquid anti-vibration medium in said main container for generating a vibratory counter force against a vibration force exerted on the construction;

two pairs of pneumatic chambers defined in upper portions of said main container, a first pair of said pneumatic chambers being arranged for causing pressure variation of pneumatic energy transmission medium therein in mutually opposite directions in response to reciprocating flow of said working liquid anti-vibration medium in a first direction, and a second pair of said pneumatic chambers being arranged for causing pressure variation of pneumatic energy transmission medium therein in mutually opposite directions in response to reciprocating flow of said working liquid anti-vibration medium in a second direction perpendicular to said first direction and in a common horizontal plane;

a first damping mechanism communicated with said first pair of pneumatic chambers for damping pressure variation in said first pair of pneumatic chambers and thereby damping reciprocating flow of said working liquid anti-vibration medium in said first direction;

a second damping mechanism communicated with said second pair of pneumatic chambers for damping pressure variation in said second pair of pneumatic chambers and thereby damping reciprocating flow of said working liquid anti-vibration medium in said second direction; and mechanisms provided externally to and cooperated with respective of said first and second damping mechanisms for determining damping characteristics thereof for adjustment of the natural frequency of said anti-vibration system to a natural frequency of the construction.

11. A hydrostatic anti-vibration system comprising:

a main container to be mounted on a top portion of a construction to which an anti-vibration effect is to be applied, said main container being filled with a working liquid anti-vibration medium for converting vibration energy transmitted to said main container from the construction according to vibratory motion thereof into a reciprocating flow of said working liquid anti-vibration medium in said main container for generating a vibratory counter force against a vibration force exerted on the construction;

two pairs of pneumatic chambers defined in upper portions of said main container, a first pair of said pneumatic chambers being arranged for causing pressure variation of pneumatic energy transmission medium therein in mutually opposite directions in response to reciprocating flow of said working liquid anti-vibration medium in a first direction, and a second pair of said pneumatic chambers being arranged for causing pressure variation of pneumatic energy transmission medium therein in mutually opposite directions in response to reciprocating, flow of said working liquid anti-vibration medium in a second direction perpendicular to said first direction and in a common horizontal plane;

a first damping mechanism communicated with said first pair of pneumatic chambers for damping pressure variation in said first pair of pneumatic chambers and thereby damping reciprocating flow of said working liquid anti-vibration medium in said first direction;

first phase reversing means for reversing a phase of pressure variation between said first pair of pneumatic chambers in said main container and said first damping mechanism, thereby avoiding influence therein of a working liquid anti-vibration medium originated pressure variation on the anti-vibration effect of said anti-vibration system;

a second damping mechanism communicated with said second pair of pneumatic chambers for damping pressure variation in said second pair of pneumatic chambers and thereby damping reciprocating flow of said working liquid anti-vibration medium in said second direction; and second phase reversing means for reversing a phase of pressure variation between said second pair of pneumatic chambers in said main container and said second damping mechanism, thereby avoiding influence therein of a working liquid anti-vibration medium originated pressure variation on the anti-vibration effect of said anti-vibration system.

12. A hydrostatic anti-vibration system comprising:

a main container to be mounted on a top portion of a construction to which an anti-vibration effect is to be applied, said main container being filled with a working liquid anti-vibration medium for converting vibration energy transmitted to said main container from the construction according to vibratory motion thereof into a reciprocating flow of said working liquid anti-vibration medium in said main container for generating a vibratory counter force against a vibration force exerted on the construction;

two pairs of pneumatic chambers defined in upper portions of said main container, a first pair of said pneumatic chambers being arranged for causing pressure variation of pneumatic energy transmission medium therein in mutually opposite directions in response to reciprocating flow of said working liquid anti-vibration medium in a first direction, and a second pair of said pneumatic chambers being arranged for causing pressure variation of pneumatic energy transmission medium therein in mutually opposite directions in response to reciprocating flow of said working liquid anti-vibration medium in a second direction perpendicular to said first direction and in a common horizontal plane;

a first hydropneumatic damping mechanism communicated with said first pair of pneumatic chambers for damping pressure variation in said first pair of pneumatic chambers and thereby damping reciprocating flow of said working liquid anti-vibration medium in said first direction;

a second hydropneumatic damping mechanism communicated with said second pair of pneumatic chambers for damping pressure variation in said second pair of pneumatic chambers and thereby damping reciprocating flow of said working liquid anti-vibration medium in said second direction; and conduit means for establishing a limited flow rate of communication of said working liquid anti-vibration medium between said main container and said first and second hydropneumatic damping mechanisms.

13. A hydrostatic anti-vibration system comprising:

a main container to be mounted on a top portion of a construction to which an anti-vibration effect is to be applied, said main container being filled with a working liquid anti-vibration medium for converting vibration energy transmitted to said main container from the construction according to vibratory motion thereof into a reciprocating flow of said working liquid anti-vibration medium in said main container for generating a vibratory counter force against a vibration force exerted on the construction;

two pairs of pneumatic chambers defined in upper portions of said main container, a first pair of said pneumatic chambers being arranged for causing pressure variation of pneumatic energy transmission medium therein in mutually opposite directions in response to reciprocating flow of said working liquid anti-vibration medium in a first direction, and a second pair of said pneumatic chambers being arranged for causing pressure variation of pneumatic energy transmission medium therein in mutually opposite directions in response to reciprocating flow of said working liquid anti-vibration medium in a second direction perpendicular to said first direction and in a common horizontal plane;

a first damping mechanism communicated with said first pair of pneumatic chambers for damping pressure variation in said first pair of pneumatic chambers and thereby damping reciprocating flow of said working liquid anti-vibration medium in said first direction;

first phase reversing means for reversing a phase of pressure variation between said first pair of pneumatic chambers in said main container and said first damping mechanism, thereby avoiding influence therein of a working liquid anti-vibration medium originated pressure variation on the anti-vibration effect of said anti-vibration system;

a second damping mechanism communicated with said second pair of pneumatic chambers for damping pressure variation in said second pair of pneumatic chambers and thereby damping reciprocating flow of said working liquid anti-vibration medium in said second direction;

second phase reversing means for reversing a phase of pressure variation between said second pair of pneumatic chambers in said main container and said second damping mechanism, thereby avoiding influence of a working liquid anti-vibration medium originated pressure variation on the anti-vibration effect of said anti-vibration system; and mechanisms provided externally to and cooperated with respective of said first and second damping mechanisms for determining damping characteristics thereof for adjustment of the natural frequency of said anti-vibration system to a natural frequency of the construction.

14. A hydrostatic anti-vibration system comprising:

a main container to be mounted on a top portion of a construction to which an anti-vibration effect is to be applied, said main container being filled with a working liquid anti-vibration medium for converting vibration energy transmitted to said main container from the construction according to vibratory motion thereof into a reciprocating flow of said working liquid anti-vibration medium in said main container for generating a vibratory counter force against a vibration force exerted on the construction;

two pairs of pneumatic chambers defined in upper portions of said main container, a first pair of said pneumatic chambers being arranged for causing pressure variation of pneumatic energy transmission medium therein in mutually opposite directions in response to reciprocating flow of said working liquid anti-vibration medium in a first direction, and a second pair of said pneumatic chambers being arranged for causing pressure variation of pneumatic energy transmission medium therein in mutually opposite directions in response to reciprocating flow of said working liquid anti-vibration medium in a second direction perpendicular to said first direction and in a common horizontal plane;

a first hydropneumatic damping mechanism communicated with said first pair of pneumatic chambers for damping pressure variation in said first pair of pneumatic chambers and thereby damping reciprocating flow of said working liquid anti-vibration medium in said first direction;

first phase reversing means for reversing a phase of pressure variation between said first pair of pneumatic chambers in said main container and said first damping mechanism, thereby avoiding influence of a working liquid anti-vibration medium originated pressure variation on the anti-vibration effect of said anti-vibration system;

a second hydropneumatic damping mechanism communicated with said second pair of pneumatic chambers for damping pressure variation in said second pair of pneumatic chambers and thereby damping reciprocating flow of said working liquid anti-vibration medium in said second direction;

second phase reversing means for reversing a phase of pressure variation between said second pair of pneumatic chambers in said main container and said second damping mechanism, thereby avoiding influence of a working liquid anti-vibration medium originated pressure variation on the anti-vibration effect of said anti-vibration system; and conduit means for establishing a limited flow rate of communication of said working liquid anti-vibration medium between said main container and said first and second hydropneumatic damping mechanisms.

15. A hydrostatic anti-vibration system comprising:

a main container to be mounted on a top portion of a construction to which an anti-vibration effect is to be applied, said main container being filled with a working liquid anti-vibration medium for converting vibration energy transmitted to said main container from the construction according to vibratory motion thereof into a reciprocating flow of said working liquid anti-vibration medium in said main container for generating a vibratory counter force against a vibration force exerted on the construction;

two pairs of pneumatic chambers defined in upper portions of said main container, a first pair of said pneumatic chambers being arranged for causing pressure variation of pneumatic energy transmission medium therein in mutually opposite directions in response to reciprocating flow of said working liquid anti-vibration medium in a first direction, and a second pair of said pneumatic chambers being arranged for causing pressure variation of pneumatic energy transmission medium therein in mutually opposite directions in response to reciprocating flow of said working liquid anti-vibration medium in a second direction perpendicular to said first direction and in a common horizontal plane;

a first hydropneumatic damping mechanism communicated with said first pair of pneumatic chambers for damping pressure variation in said first pair of pneumatic chambers and thereby damping reciprocating flow of said working liquid anti-vibration medium in said first direction;

first phase reversing means for reversing a phase of pressure variation between said first pair of pneumatic chambers in said main container and said first damping mechanism, thereby avoiding influence of a working liquid anti-vibration medium originated pressure variation on the anti-vibration effect of said anti-vibration system;

a second hydropneumatic damping mechanism communicated with said second pair of pneumatic chambers for damping pressure variation in said second pair of pneumatic chambers and thereby damping reciprocating flow of said working liquid anti-vibration medium in said second direction;

second phase reversing means for reversing a phase of pressure variation between said second pair of pneumatic chambers in said main container and said second damping mechanism, thereby avoiding influence of a working liquid anti-vibration medium originated pressure variation on the anti-vibration effect of said anti-vibration system;

mechanisms provided externally to and cooperated with respective of said first and second damping mechanisms for determining damping characteristics thereof for adjustment of the natural frequency of said anti-vibration system to a natural frequency of the construction; and conduit means for establishing a limited flow rate of communication of said working anti-vibration medium between said main container and said first and second hydropneumatic damping mechanisms.

* * * * *